US007604859B2

(12) United States Patent
Liu et al.

(10) Patent No.: US 7,604,859 B2
(45) Date of Patent: Oct. 20, 2009

(54) HEAT ADHESIVE BIODEGRADABLE BICOMPONENT FIBERS

(75) Inventors: Tsung-Hung Liu, Hsinchu (TW); Tsan-Chin Chang, Hsinchu (TW); Shih-Hsiung Chen, Hsinchu (TW); Zin-Chin Wu, Hsinchu (TW); Ping-Cheng Wu, Hsinchu (TW)

(73) Assignee: Far Eastern Textile Ltd., Taipei (TW)

( * ) Notice: Subject to any disclaimer, the term of this patent is extended or adjusted under 35 U.S.C. 154(b) by 464 days.

(21) Appl. No.: 11/468,307

(22) Filed: Aug. 30, 2006

(65) Prior Publication Data

US 2008/0057309 A1 Mar. 6, 2008

(51) Int. Cl.
*D02G 3/00* (2006.01)

(52) U.S. Cl. ..... 428/370; 428/373; 428/374

(58) Field of Classification Search ..... 428/370, 428/373, 374

See application file for complete search history.

(56) References Cited

U.S. PATENT DOCUMENTS 5,593,778 A * 1/1997 Kondo et al. ..... 428/373
6,124,384 A * 9/2000 Shiraishi et al. ..... 524/35
6,174,602 B1 * 1/2001 Matsui et al. ..... 428/373
6,440,556 B2 * 8/2002 Matsui et al. ..... 428/370
6,579,617 B2 * 6/2003 Matsui et al. ..... 428/364
6,607,996 B1 * 8/2003 Matsunaga et al. ..... 442/327
6,844,062 B2 * 1/2005 Matsui et al. ..... 428/370
2003/0207110 A1 * 11/2003 Matsui et al. ..... 428/395
2004/0258917 A1 * 12/2004 Matsui et al. ..... 428/395
2005/0026529 A1 * 2/2005 Bond et al. ..... 442/415
2007/0224903 A1 * 9/2007 Chakravarty et al. ..... 442/361
2008/0050603 A1 * 2/2008 Randall et al. ..... 428/480
2008/0057309 A1 * 3/2008 Liu et al. ..... 428/375

* cited by examiner

*Primary Examiner*—N. Edwards
(74) *Attorney, Agent, or Firm*—WPAT, P.C.; Justin I. King

(57) ABSTRACT

The present invention discloses a heat adhesive biodegradable bicomponent fiber comprising a polylactic-acid-based low melting component and a high melting component, wherein the low melting component constitutes the sheath of the fiber, and the high melting component constitutes the core of the fiber. The material of the low melting component comprises unmodified polylactic acid or a blending with unmodified polylactic acid and modified polylactic acid. The modified polylactic acid is modified by blending unsaturated dicarboxylic acid, unsaturated anhydride or their derivatives with polylactic acid. The bicomponent fiber provided in this invention is biodegradable, environmentally benign and with excellent bonding performance to polylactic acid fibers, chemical fibers and cellulose fibers.

16 Claims, 2 Drawing Sheets

HEAT ADHESIVE BIODEGRADABLE BICOMPONENT FIBERS

BACKGROUND OF THE INVENTION

1. Field of the Invention

The present invention is generally related to a heat adhesive bicomponent fiber, and more particularly to a heat adhesive biodegradable bicomponent fiber.

2. Description of the Prior Art

Heat adhesive bicomponent fibers have been extensively applied in the field of synthetic fibers, such as polyester, polyamide and polyolefin fibers. These fibers are mostly used in nonwoven processes, especially in disposable nonwoven fabrics that thereby results in waste disposal problem.

For example, disposable diaper comprises an absorbent layer that comprises a water permeable surface layer, a water impermeable rear layer, and a single-layer or multi-layer structure for liquid dispersion wherein the material of the absorbent layer generally comprises natural fiber, such as cellulose fluff pulp fiber, and polyolefin and/or polyester based synthetic fibers and super absorbent polymer (SAP) substance. The synthetic fibers generally are polypropylene/polyethylene or polyester/polyethylene bicomponent fibers that are heat treated to adhere to each other to form a supporting web structure. In an ideal situation, the bicomponent synthetic fibers bond together and also bond with natural fibers and the super absorbent polymers to form the above described supporting web structure.

In addition, nonwoven fabrics manufactured by a spunlace nonwoven fabric process are extensively used in the products of wiping fabrics. These products usually use rayon as the main body and add bicomponent polyester low melting bicomponent fibers or add bicomponent polyolefin fibers or polyester fibers and thereby increase the physical property of the nonwoven fabrics by heat bonding process.

However, the products made by either polypropylene/polyethylene or polyester/polyethylene bicomponent fibers are not biodegradable after disposal and thus pollute the environment. Therefore, developing a biodegradable and heat adhesive fiber is an important subject as well as an important research aspect for the industry.

SUMMARY OF THE INVENTION

In view of the above described background, the present invention provides a new heat adhesive biodegradable bicomponent fiber to meet the requirements of the industry.

One object of the present invention is to manufacture a fiber by using a polylactic-acid-based low melting component and a high melting component. Because polylactic acid material is taken from natural corn, not from petroleum, raw material will not be depleted and also satisfies the modern trend of green energy resources. Furthermore, the fiber provided in this invention has excellent thermal bonding with other fibers. In addition, this invention provided a good thermal bonding performance bicomponent fiber to bond with other fibers. Furthermore, in order to increase the bonding performance with natural cotton, pulp fibers, and regenerated fibers, such as rayon and cellulose fibers, it can be by using modified polylactic acid as the sheath of the bicomponent fiber.

Another object of the present invention is to choose the melting points of sheath portion and core portion of fiber by means of the ratio between L-lactic acid and D-lactic acid. Base on the theory that the increasing of the L-lactic acid content of the polylactic acid, the degree of crystalline and the melting point of fiber which made with the polylactic acid is increased. Another object of the present invention is to carry out melt spinning process of polylactic acid bicomponent fibers by a melting-spinning equipment to manufacture heat adhesive biodegradable bicomponent fibers. Therefore, this present invention does have the economic advantage for industrial applications.

Accordingly, the present invention discloses a heat adhesive biodegradable bicomponent fiber comprising a polylactic-acid-based low melting component and a high melting component, wherein the low melting component constitutes the sheath of the fiber, and the high melting component constitutes the core of the fiber. The material of the high melting component comprises one of the following groups: polylactic acid, polyolefin, polyester, and polyamide. Furthermore, the material of the low melting component comprises unmodified polylactic acid or a mixture of unmodified polylactic acid and modified polylactic acid. The modified polylactic acid is modified by adding unsaturated dicarboxylic acid, unsaturated anhydride or their derivatives with polylactic acid. The bicomponent fiber provided in this invention is biodegradable, environmentally benign and with excellent bonding performance to polylactic acid fibers, chemical fibers and cellulose fibers.

DESCRIPTION OF THE PREFERRED EMBODIMENTS

What is probed into the invention is a heat adhesive biodegradable bicomponent fiber. Detail descriptions of the processes and compositions will be provided in the following in order to make the invention thoroughly understood. Obviously, the application of the invention is not confined to specific details familiar to those who are skilled in the art. On the other hand, the common elements or processes that are known to everyone are not described in details to avoid unnecessary limits of the invention. Some preferred embodiments of the present invention will now be described in greater detail in the following. However, it should be recognized that the present invention can be practiced in a wide range of other embodiments besides those explicitly described, that is, this invention can also be applied extensively to other embodiments, and the scope of the present invention is expressly not limited except as specified in the accompanying claims.

Definition

The "polylactic-acid-based" in the present invention means that a mixture of polylactic acid and copolymer and/or other substance, in which the polylactic acid is the main composition. The other substance comprises artificial polymers, such as polyester, polyamide, or polyolefin, or traditional fiber additives, such as antioxidant, process stabilizer, compatilizer, and pigment (whitener and pigment).

In the first embodiment of the present invention, a heat adhesive biodegradable bicomponent fiber is provided comprising a polylactic-acid-based low melting component and a polylactic-acid-based high melting component. In certain cases, the difference in melting point between the two polylactic-acid-based component is at least 10° C. It is generally said that the two components have melting points difference at least about 15° C., preferably at least about 25° C., and more preferably at least about 30° C. In a preferred example of this embodiment, the low melting component constitutes the sheath of the fiber, and the high melting component constitutes the core of the fiber. The weight ratio between the low melting component and the high melting component is in the range of 10:90 to 90:10, typically about 30:70 to 70:30, more typically about 40:60 to 60:40, e.g. 45:55 to 55:45.

Figure 1:
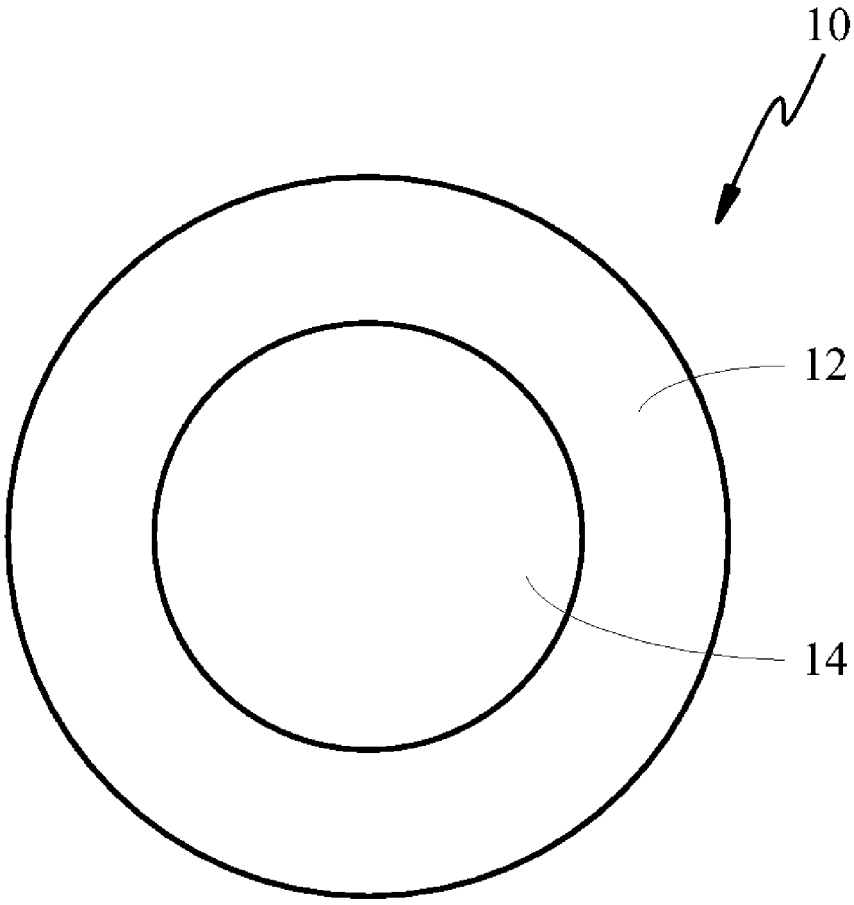
FIG. 1 is a cross-sectional schematic diagram of the heat adhesive biodegradable bicomponent fiber according to a first embodiment of the present invention.

In this embodiment, the structure of the sheath/core bicomponent fiber means that the core portion is wrapped in the sheath portion. The core being located either eccentrically (off-center) or concentrically (substantially in the center) as shown in FIG. 1, element 10 shows a bicomponent fiber, element 12 shows a polylactic-acid-based low melting component, and element 14 shows a polylactic-acid-based high melting component or the side by side type (e.g. each has a semi-circular cross section). Bicomponent fiber having irregular fiber profiles, e.g. an oval, ellipse, triangle and other irregular cross-section.

In this embodiment, in order to have thermal bonding (heat adhesion) property of bicomponent fibers, the melting point of the sheath must be lower than that of the core. The "heat adhesion" is a common technique for making nonwoven fabrics by heating fibers. When the heating temperature is higher than the melting or softening point of the sheath portion of the bicomponent fiber, the bicomponent fiber adheres to other fibers. The two polylactic-acid-based components mainly comprise L-lactic acid and D-lactic acid. The melting point of the high melting component is in the range of 155° C. to 170° C. For the high melting component, the weight ratio between D-lactic acid (included the additives) and L-lactic acid is in the range of from 0.5:99.5 to 4:96. The melting point of the low melting component is in the range of from 125° C. to 155° C., typically about 130° C. or 150° C. For the low melting component, the weight ratio of the D-lactic acid (included the additives) and L-lactic acid is in the range of from 3.5:96.5 to 10:90. Generally, the melting point of polylactic acid depends on the weight ratio between L-lactic acid and D-lactic acid. The higher the D-lactic acid content the lower the melting point is. The present invention is according to this principle to choose the melting points of the component sheath and the component core.

The heat adhesive biodegradable bicomponent fiber according to this embodiment can be applied in numerous fields and can be used as heat adhesive material for various nonwoven fabrics, such as carded hot-air boned nonwoven fabrics, hot pressed bonded nonwoven fabrics, airlaid nonwoven fabrics, wetlaid nonwoven fabrics, nonwoven fabrics by a spunlace process. Furthermore, the heat adhesive biodegradable bicomponent fiber can be blended with other synthetic fibers or natural fibers, such as cotton and wool, play a role of binder in spun yarn to increase the tenacity of yarn and reduce abrasion for knitting and weaving.

A nonwoven comprising the bicomponent fibers and the additional fibrous material typically comprises 15%~50% by weight of bicomponent fibers and 50%~85% by weight of the additional fibrous material, more typically 10%~40% by weight of bicomponent fibers and 60%~90% of the additional fibrous material, such as 15%~25% by weight of bicomponent fibers and 75%~85% by weight of the additional fibrous material.

As indicated above, nonwovens of the present invention typically comprise polylactic acid bicomponent fiber and other additional fibrous material. The additional fibrous material can be ploylactic acid monocomponent fibers, other synthetic fibers e.g. polyester fibers, Nylon fibers, polyolefin fibers. Furthermore the additional fibrous material also can be natural fibers or regenerated fibers, e.g. selected from cellulose fibers and viscose rayon fibers. Cellulose fibers may be pulp fibers or cotton fibers, and are in particular fibers pulp fibers such as chemi-thermo-mechanical pulp (CTMP), sulfite pulp, and kraft pulp.

The heat adhesive biodegradable bicomponent fiber according to this embodiment has good thermal bonding performance with other fibers.

In order to satisfy some special applications which need higher thermal bonding strength between bicomponent fiber and other fibers, especially for bonding with natural cotton, pulp fibers, and regenerated fibers (such as rayon and cellulose fibers). So in the second embodiment, thermal bonding performance of the bicomponent can be further enhanced by using a modified low melting polylactic acid component blend with unmodified low melting polylactic acid component through melt spinning process as the sheath of the biodegradable bicomponent fiber.

Follow above mentioned, the sheath portion of modified biodegradable bicomponent fiber is made with the mixture of modified low melting polylactic acid and unmodified low melting polylactic acid by weight between 1:99 and 50:50, typically between 1.5:98.5 and 30:70, and more typically between 2:98 and 20:80 (for example, between 3:97 and 15:85 or between 5:95 and 10:90). In which the modified polylactic acid is made by blending with modifier and low melting polylactic acid at the ratio 0.1~8 wt. % and 92~99.9 wt. % through a twin-screw extruder system.

The modifier include unsaturated bicarboxylic acid (such as maleic acid), unsaturated anhydride (such as maleic anhydride and styrene maleic anhydride (SMA)), and their derivatives.

Within the modified low melting polylactic acid, the content of the modifier is about 0.1%~8% by weight, typically about 0.5%~3% by weight, and more typically about 1%~3% by weight (for example, 2% by weight). The weight ratio between the polylactic-acid-based low melting component and high melting component in the bicomponent fiber, the fiber applications, the mixing ratio between bicomponent fiber and additional fibrous material in nonwoven are the same as those in the first embodiment.

In this embodiment, the unmodified low melting polylactic acid mainly comprises L-lactic acid and D-lactic acid. The melting point of the unmodified low melting polylactic acid is in the range of 125° C. to 155° C., preferably about 130° C. to 150° C. Within the melting point of low melting component, its weight ratio of the D-lactic acid (included the additives) and L-lactic acid is in the range of from 3.5:96.5 to 10:90.

For clarity, staple fiber hereinafter is referred to as "fiber". The fineness of fiber according to the present invention is about 0.5~100 denier, typically 1.5~10 denier. The length of fiber is about 3~200 mm. The fiber length of carding process is about 32~200 mm and fiber length of the drylaid or wetlaid process is about 3~32 mm.

EXAMPLE 1

Manufacturing 2 Denier Sheath/Core Bicomponent Fiber

Figure 2:
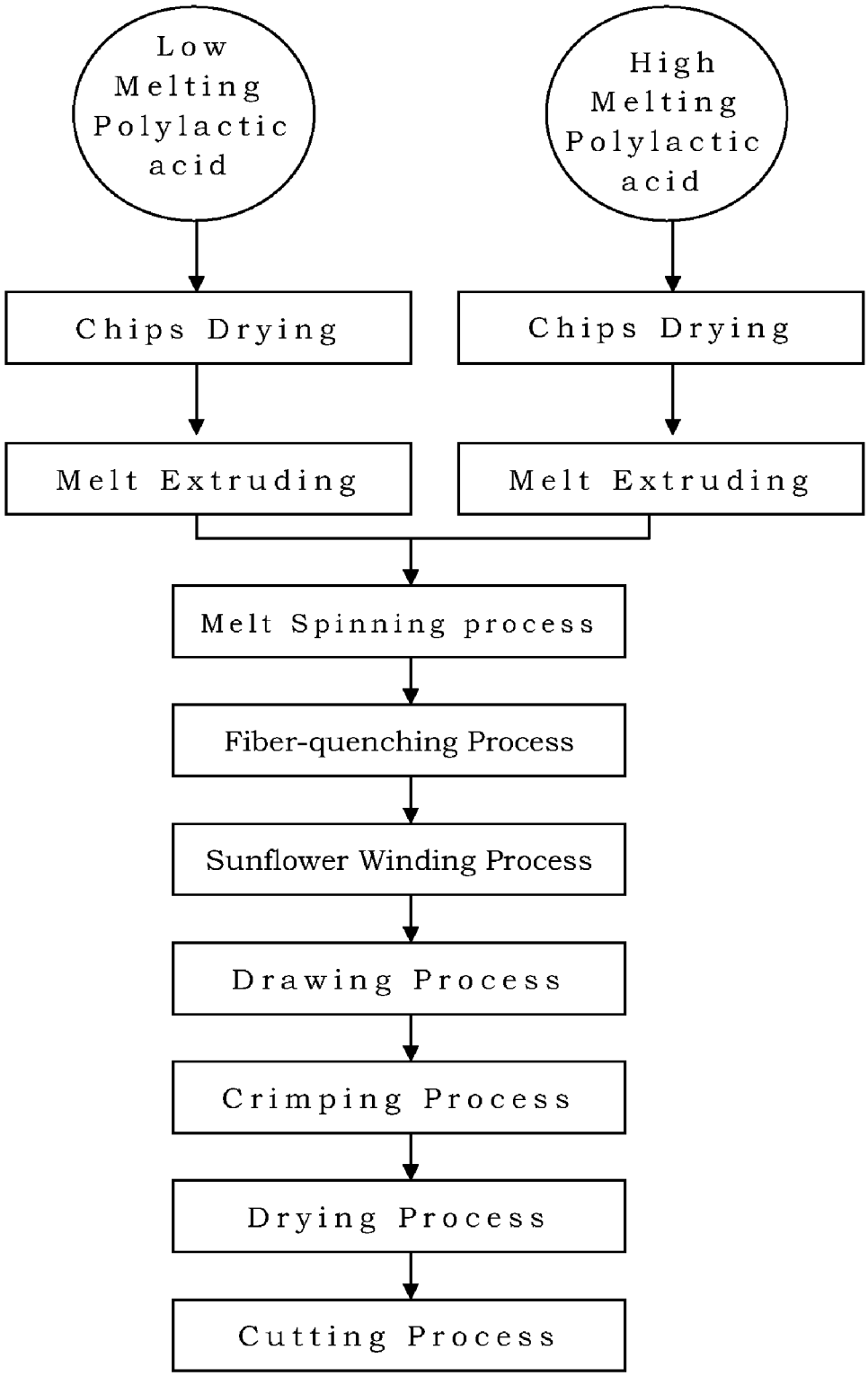
FIG. 2 is a process flow chart for manufacturing the heat adhesive biodegradable bicomponent fiber according to a third embodiment of the present invention.

Referring to FIG. 2, a method for manufacturing a sheath/core bicomponent fiber, shown in the following.

Low melting polylactic acid raw material 6300D from Nature Works (the content of D-lactic acid is 8.5 wt % and Tm=132° C.) is used as the sheath of the bicomponent fiber. On the other hand, high melting polylactic acid raw material 6201D from Nature Works (the content of D-lactic acid is 1.4 wt % and Tm=168° C.) is used as the core of the bicomponent fiber.

Independent dryer systems are used to dry the two polylactic acid raw materials to below 50 ppm of moisture content. The sheath (6300D) and the core (6201D) are melted by each extruder. The extruder for the sheath is divided into six heating zones and the temperatures are set to 190, 200, 200, 210, 210, and 210° C. Comparatively, the extruder for the core also can be divided into six heating zones and the temperatures are set to be 220, 230, 235, 237, 237, and 237° C.

The melted polylactic acid polymer for the sheath and the core portions from extruders flow through the individual distribution pipe. The distribution pipe is controlled at constant temperature. The melt distribution pipe for the sheath is controlled at 220° C. by heating medium and the melt distribution pipe for the core is controlled at 232° C. by heating medium.

The sheath and core melted polymer are distributed to each spinneret via the distribution pipes. The spinnerets are designed with sheath/core melt fluid channels individually to make the fiber with sheath/core structure. The weight ratio of sheath/core is 50/50, the number of the spinneret holes is 600, hole diameter=0.4 mm, and throughput=540 g/min. The temperature of the quenching air is 18° C. and air flow=350 $m^3$/hr, the cable is fed into the cable can by sunflower winding system with a take-up speed of 1300 m/min.

Cable cans are collected to get the total denier of 2,200,000 den. The cable is then drawn by a drawing equipment with 3.5 of drawing ratio. The roller's surface temperature of drawing stands have to be controlled precisely at 58° C.~60° C. and the neck point of cable should be controlled do not let the undrawn fiber to enter the high temperature of drawing bath to avoid the fused fibers. The drawing bath is between two drawing stands and hot water fill up the drawing bath with temperature of 85° C. 95° C. to draw the fibers completely. Roller heatsetting is carried out on the rollers of the third and fourth drawing stands with heatsetting temperature of 95° C. ~100° C.

After completion of heatsetting, crimp of fibers is carried out by a crimping machine. In the crimping process, tow temperature must be controlled at 50~55° C. to prevent fiber fused. The fibers is applied specific finish, the oil content with 0.25~0.30% by weight, then entered the tow into dryer with 100~105° C. of dry temperature. The fiber had cut to specific length by a cutting machine. The cutting length depends on the nonwoven manufacturing process. For example, the fiber length of air-laid process is about 3 mm~12 mm, the fiber length of carding process is about 32~76 mm.

The bicomponent polylactic acid fiber has the physical properties as follows: fiber fineness=2.05 denier, single fiber strength=3.3 g/d, elongation=48%, and hot air shrinkage percentage can be below to 6% under the condition of 100° C. for 15 min.

EXAMPLE 2

Manufacturing 2 Denier Modified Sheath/Core Bicomponent Fiber

Keep the low melting polylactic acid chips (nature works 6300D) and maleic anhydride chips at the ratio 96.5 wt. % and 3.5 wt. %, after mixing and drying procedure then feed into a twin-screw extruder. The chips are melted and completely blended by twin-screw extruder system to get the modified polylactic acid polymer. The melted modified polylactic acid is extruded from the extrusion die and thus cooled, granulated to get the modified polylactic acid chips.

Modified polylactic acid and low melting polylactic acid are mixing well with the ratio 15 wt. % and 85 wt. % are used as the sheath portion of the bicomponent fiber. On the other hand, high melting polylactic acid raw material 6201D from Nature Works (the content of D-lactic acid is 1.4 wt % and Tm=168° C.) is used as the core of the bicomponent fiber. The bicomponent fiber is made by below melt spinning process.

The independent dryer systems are used to dry the polylactic acid raw materials to below 50 ppm of moisture content. The sheath (6300D added modified polylactic acid) and the core (6201D) are melted by each extruder. The extruder for the sheath is divided into six heating zones and the temperatures are set to 190, 200, 200, 210, 210, and 210° C. Comparatively, the extruder for the core also can be divided into six heating zones and the temperatures are set to be 220, 230, 235, 237, 237, and 237° C.

The melted polylactic acid polymer for the sheath and the core portions from extruders flow through the individual distribution pipes. The distribution pipe is controlled at constant temperature. The melt distribution pipe for the sheath is controlled at 220° C. by heating medium and the melt distribution pipe for the core is controlled at 232° C. by heating medium.

The sheath and core melted polymer are distributed to each spinneret via the distribution pipes. The spinnerets are designed with sheath/core melt fluid channels individually to make the fiber with sheath/core structure. The weight ratio of sheath/core is 50/50, the number of the spinneret holes is 600, hole diameter=0.4 mm, and throughput=540 g/min. The temperature of the quenching air is 18° C. and air flow=350 $m^3$/hr, the cable is fed into the cable can by sunflower winding system with a take-up speed of 1300 m/min.

Cable cans are collected to get the total denier of 2,200,000 den. The cable is then drawn by a drawing equipment with 3.5 of drawing ratio. The roller's surface temperature of drawing stands have to be controlled precisely at 58° C.~60° C. and the neck point of cable should be controlled do not let the undrawn fiber to enter the high temperature of drawing bath to avoid the fused fibers. The drawing bath is between two drawing stands and hot water fill up the drawing bath with temperature of 85° C.~95° C. to draw the fibers completely. Roller heatsetting is carried out on the rollers of the third and fourth drawing stands with heatsetting temperature of 95° C.~100° C.

After completion of heatsetting, crimp of fibers is carried out by a crimping machine. In the crimping process, tow temperature must be controlled at 50~55° C. to prevent fiber fused. The fibers is applied specific finish, the oil content with 0.25~0.30% by weight, then entered the tow into dryer with 100~105° C. of dry temperature. The fiber had cut to specific length by a cutting machine. The cutting length depends on the nonwoven manufacturing process. For example, the fiber length of air-laid process is about 3 mm~12 mm, the fiber length of carding process is about 32~76 mm.

The bicomponent polylactic acid fiber has the physical properties as follows: fiber fineness=2.1 denier, single fiber strength=3.1 g/d, elongation=42%, and hot air shrinkage percentage can be below to 6% under the condition of 100° C. for 15 min.

Hot Air Shrinkage Percentage Test for Single Fiber:

Ten pieces of fiber with a length of about 12~13 cm are taken out from the bicomponent polylactic acid fiber tow. Two ends of the fiber are pulled to be straight (no tension on the fiber) and thereby mounted on an aluminum plate. The original fiber length (LD) is thus measured. The sample fibers placed in an oven with a temperature of 100° C. for 15 min. After the sample fibers sat to be cooled for 30 min then measured the length of fibers. The hot air shrinkage percentage of the bicomponent polylactic acid fiber can be smaller than or equal to 6%, typically about 1~3%. The formula for calculating the hot air shrinkage percentage is as follows:

$$S(\%) = \left(LD - \frac{L}{LD}\right) * 100\%$$

in which

S(%): hot air shrinkage percentage for fiber;

LD: original fiber length; and,

L: fiber length after thermal treatment.

Because the take-up speed of the staple fiber process is about 500 to 2000 m/min, there is almost no crystallization in the fiber at such take-up speed. Therefore, a drawing process is carried out to make the fiber crystallize. According to research, the heat of fusion of the 100% crystallization of polylactic acid is 93 Joules/gram. For example, the weight ratio between the polylactic-acid-based low melting component and the high component (sheath/core) is 45:55, wherein the polylactic-acid-base low melting component comprises 8.5% by weight of D-lactic acid and the polylactic-acid-based high melting component comprises 1.4 wt % of D-lactic acid. Analyzing the bicomponent fiber by DSC (Differential Scanning Calorimeter), the heat fusion of the polylactic-acid-based low melting component is about 12 Joules/gram and the heat fusion of the polylactic-acid-based high melting component is about 32 Joules/gram. Therefore, the degree of crystalline for the polylactic-acid-based low melting component is 29% and the polylactic-acid-based high melting component is 62%.

Thermal Bonding Performance Test:

The following test is for unmodified polylactic acid bicomponent fiber (as described in Example 1), modified polylactic acid bicomponent fibers (as described in Example 2), polyolefin bicomponent fibers, and polyolefin/polyester bicomponent fibers. In addition, the weight ratio of the core portion and the sheath portion in the modified and unmodified polylactic acid bicomponent fibers are also adjusted. This experiment evaluates the bonding strength of the bicomponent fibers with cellulose fibers and monocomponent polylactic acid fibers. As indicated above, the bicomponent fibers which for the test is 2 denier and 38 mm of length.

EXAMPLE 3

The object of this test is to evaluate the bonding performance between polylactic-acid-based bicomponent fibers and mono-component fibers by different weight ratio of the sheath and the core portion of the bi-component fibers and also to compare with the hand feeling of nonwoven.

In this test, 50 g of sample fibers with 75% by weight of polylactic-acid-base monocomponent fibers (had a fineness of 6 denier and a length of 64 mm) and 25% by weight of polylactic-acid-base bicomponent fiber is used. The sample fibers carded by carding machine twice and made the web with basis weight 250 g/m$^2$. The web is placed in an oven for thermal bonding process at 140° C.×5 min. After bonding process, the nonwoven is taken out from the oven and cut into individual samples with a size of 5 cm×30 cm for tensile tests by a tensile test machine (INSTRON-4301) to measure the nonwoven strength and elongation. The data are shown in Tables 1 and 2.

TABLE 1

| Item | Type | Sheath | Core | Sheath/core ratio (wt %) |
|---|---|---|---|---|
| 1 | polylactic acid bicomponent fiber | Low melting polylactic acid (NATURE WORKS 6300D) | high melting polylactic acid (NATURE WORKS 6201D) | 50/50 |
| 2 | polylactic acid bicomponent fiber | Low melting polylactic acid (NATURE WORKS 6300D) | high melting polylactic acid (NATURE WORKS 6201D) | 45/55 |
| 3 | polylactic acid bicomponent fiber | Low melting polylactic acid (NATURE WORKS 6300D) | high melting polylactic acid (NATURE WORKS 6201D) | 40/60 |

TABLE 2

Thermal bonding strength and elongation (cutting length = 38 mm) of the sample with the same bonding temperature

| Item | bonding temperature (° C.) | strength (kg) | elongation (%) | shrinkage (%) | Nonwoven fabric hand feeling |
|---|---|---|---|---|---|
| 1 | 140 | 24.9 | 32.0 | 14.2 | Hard |
| 2 | 140 | 21.2 | 25.8 | 12.6 | Slightly hard |
| 3 | 140 | 18.1 | 26.0 | 10.3 | soft |

The result shows that thermal bonding strength and elongation of the nonwoven increase with the increase of the sheath portion content. In addition, shrinkage and hand feeling of the nonwoven is from soft to hard with the weight ratio of sheath portion increased.

EXAMPLE 4

The object of this test run with different weight ratio of the sheath and the core portions of the polylactic-acid-base bicomponent fibers to evaluate their bonding ability to rayon fibers. In the test, 20 g of sample fibers comprise 70% by weight of rayon (from Vicunha Textile S/A; fiber fineness=2 denier; length=38 mm) and 30% by weight of polylactic-acid-base bicomponent fiber. The sample fibers carded by carding machine twice and made the web with basis weight 100 g/m$^2$. The web is thus placed in an oven for bonding temperature of 125° C., 135° C., and 145° C. for 3 min individually. After bonding process, the nonwoven is taken out from the oven and cut into individual samples with a size of 5 cm×30 cm for tensile tests by a tensile test machine (INSTRON-4301) to measure the nonwoven strength and elongation. The data are shown in Tables 3 and 4.

TABLE 3

| Item | Type | Sheath | Core | Sheath/core ratio (wt %) |
|---|---|---|---|---|
| 1 | polylactic acid bicomponent fiber | Low melting polylactic acid (NATURE WORKS 6300D) | high melting polylactic acid (NATURE WORKS 6201D) | 50/50 |
| 2 | polylactic acid | Low melting polylactic acid | high melting polylactic acid | 45/55 |

TABLE 3-continued

| Item | Type | Sheath | Core | Sheath/core ratio (wt %) |
|---|---|---|---|---|
| | bicomponent fiber | (NATURE WORKS 6300D) | (NATURE WORKS 6201D) | |
| 3 | polylactic acid bicomponent fiber | Low melting polylactic acid (NATURE WORKS 6300D) | high melting polylactic acid (NATURE WORKS 6201D) | 40/60 |

TABLE 4

Thermal bonding strength and elongation (cutting length = 38 mm) of the sample with different bonding temperature

| Item | bonding temperature (° C.) | strength (kg) | elongation (%) | shrinkage (%) |
|---|---|---|---|---|
| 1 | 125 | 2.2 | 16.1 | 10.3 |
| 1 | 135 | 2.7 | 17.2 | 12.8 |
| 1 | 145 | 3.2 | 18.0 | 12.4 |
| 2 | 125 | 1.7 | 13.1 | 9.6 |
| 2 | 135 | 2.3 | 14.7 | 10.4 |
| 2 | 145 | 2.8 | 16.2 | 11.0 |
| 3 | 125 | 1.0 | 12.3 | 7.2 |
| 3 | 135 | 1.6 | 13.9 | 9.7 |
| 3 | 145 | 1.7 | 15.2 | 10.2 |

The result shows that thermal bonding strength, elongation, and shrinkage of the nonwoven fabric increase with the increase of the sheath portion content.

EXAMPLE 5

The object of this test is to evaluate the bonding performance of the bicomponent fiber to rayon fiber by using two kinds of polylactic-acid-based bicomponent fibers and two kinds of polyolefin bicomponent fibers for contrast. In which, the sheath portion of modified polylactic-acid-based bicomponent fiber added the maleic anhydride (showed as Example 2).

In the test, 20 g of sample with 70% by weight of rayon (from Vicunha Textile S/A; fiber fineness=2 denier; length=38 mm) and 30% by weight of two kind polylactic-acid-base bicomponent fibers and two kinds polyolefin bicomponent fibers are used. The sample fibers carded by carding machine twice and made the web with basis weight 100 g/m$^2$. The web is thus placed in an oven for bonding temperature of 125° C., 135° C., and 145° C. for 3 min individually. After bonding process, the nonwoven is taken out from the oven and cut into individual samples with a size of 5 cm×30 cm cm for tensile tests by a tensile test machine (INSTRON-4301) to measure the nonwoven strength and elongation. The data are shown in Tables 5 and 6.

TABLE 5

| Item | Type | Sheath | Core | Sheath/core ratio (wt %) |
|---|---|---|---|---|
| 1 | polylactic acid bicomponent fiber | Low melting polylactic acid (NATURE WORKS 6300D) | high melting polylactic acid (NATURE WORKS 6201D) | 50/50 |

TABLE 5-continued

| Item | Type | Sheath | Core | Sheath/core ratio (wt %) |
|---|---|---|---|---|
| 2 | Modified polylactic acid bicomponent fiber | Low melting polylactic acid comprising maleic anhydride | high melting polylactic acid (NATURE WORKS 6201D) | 50/50 |
| 3 | Polyolefin bicomponent fiber (PE/Polyester) | Polyethylene (USI, HDPE, MI = 20) | Polyester (IV = 0.63) | 55/45 |
| 4 | Polyolefin bicomponent fiber (PE/PP) | Polyethylene (USI HDPE, MI = 20) | Propylene (MFR = 20) | 65/35 |

TABLE 6

Thermal bonding strength and elongation (cutting length = 38 mm) of the sample with different bonding temperature

| Item | bonding temperature (° C.) | strength (kg) | elongation (%) | shrinkage (%) |
|---|---|---|---|---|
| 1 | 125 | 1.7 | 13.1 | 9.6 |
| 1 | 135 | 2.3 | 14.7 | 10.4 |
| 1 | 145 | 2.8 | 16.2 | 11.0 |
| 2 | 125 | 3.0 | 13.9 | 8.5 |
| 2 | 135 | 3.6 | 14.5 | 9.1 |
| 2 | 145 | 4.1 | 14.8 | 9.3 |
| 3 | 125 | 0.6 | 12.5 | 2.6 |
| 3 | 135 | 0.7 | 13.9 | 4.7 |
| 3 | 145 | 0.8 | 14.5 | 5.3 |
| 4 | 125 | 1.7 | 8.9 | 3.5 |
| 4 | 135 | 2.1 | 12.0 | 5.7 |
| 4 | 145 | 2.3 | 12.1 | 7.6 |

The result shows that the bonding strength of the nonwoven which made with modified polylactic-acid-based bicomponent fibers and rayon fiber (sample 2) is better than the nonwoven which made with unmodified polylactic acid bicomponent fibers and rayon fiber (sample 1). Furthermore, it is also better than the polyolefin bicomponent fibers (samples 3 and 4).

In the above preferred embodiments, the present invention uses staple fiber manufacturing processes via spinning, drawing, crimping, drying, and cutting to make staple fibers with various denier, cutting lengths to be a heat adhesive material for various nonwovens application. For example, it can be applied different nonwoven adhesion materials in numerous fields, such as carded hot-air boned nonwoven fabrics, hot pressed bonded nonwoven fabrics, airlaid process nonwoven fabrics, wetlaid process nonwoven.

To sum up, the present invention discloses a heat adhesive biodegradable bicomponent fiber comprise a polylactic-acid-based low melting component and a high melting component, wherein the low melting component constitutes the sheath of the fiber, and the high melting component constitutes the core of the fiber. Furthermore, the material of the low melting comprises unmodified polylactic acid or a mixture of unmodified polylactic acid and modified polylactic acid. The modified polylactic acid is modified by adding unsaturated dicarboxylic acid, unsaturated anhydride or their derivatives with polylactic acid. The bicomponent fiber provided in this invention is biodegradable, environmentally benign and with excellent bonding property to polylactic acid fibers, chemical fibers and cellulose fibers.

Obviously many modifications and variations are possible in light of the above teachings. It is therefore to be understood that within the scope of the appended claims the present invention can be practiced otherwise than as specifically described herein. Although specific embodiments have been illustrated and described herein, it is obvious to those skilled in the art that many modifications of the present invention may be made without departing from what is intended to be limited solely by the appended claims.

What is claimed is:

1. A heat adhesive biodegradable bicomponent fiber, comprising:

a polylactic-acid-based low melting component comprising D-lactic acid, L-lactic acid and additive, and constituting the sheath of the fiber; and a polylactic-acid-based high melting component comprising D-lactic acid, L-lactic acid and additive, and constituting the core of the fiber;

wherein the difference between the melting point of said low melting component and that of said high melting component is at least 10° C.; the ratio of said D-lactic acid to said L-lactic acid and additive by weight for said high melting component is from 0.5:99.5 to 4:96; and the ratio of said D-lactic acid to said L-lactic acid and additive by weight for said low melting component is from 3.5:96.5 to 10:90.

2. The fiber according to claim 1, wherein the ratio of said low melting component to said high melting component by weight is between 10:90 and 90:10.

3. The fiber according to claim 1, wherein the melting point range of said high melting component is about from 155° C. to 170° C.

4. The fiber according to claim 1, wherein the melting point range of said low melting component is about from 125° C. to 155° C.

5. The fiber according to claim 1, wherein said low melting component is unmodified low melting polylactic acid.

6. The fiber according to claim 1, wherein said low melting component is made by blending unmodified low melting polylactic acid with modified low melting polylactic acid.

7. The fiber according to claim 6, wherein the ratio of said modified low melting polylactic acid to said unmodified low melting polylactic acid by weight is between 1:99 and 50:50.

8. The fiber according to claim 6, wherein said modified low melting polylactic acid is modified by adding some modifier to low melting polylactic acid and said modifier comprises unsaturated bicarboxylic acid, unsaturated anhydride, and their derivatives.

9. The fiber according to claim 8, wherein said unsaturated bicarboxylic acid comprises maleic acid.

10. The fiber according to claim 8, wherein said unsaturated anhydride comprises one of the following groups: maleic anhydride and styrene maleic anhydride (SMA).

11. The fiber according to claim 8, wherein the content of said modifier is 0.1%~8% by weight of said modified low melting polylactic acid.

12. The fiber according to claim 1, wherein said heat adhesive biodegradable bicomponent fiber can be adhere to others fiber to form nonwoven fabrics.

13. The fiber according to claim 12, wherein said others fiber are synthetic or natural fiber.

14. The fiber according to claim 1, wherein said heat adhesive biodegradable bicomponent fiber is applied to short fiber application.

15. The fiber according to claim 14, wherein said short fiber are the fibers length within 3 mm~200 mm, denier within 0.8~50 den.

16. The fiber according to claim 14, wherein said short fiber are applied in manufacturing carded nonwoven fabrics, dry-laid process nonwoven fabrics, and wetlaid nonwoven process fabrics.

* * * * *